US007467429B2

(12) United States Patent
Soreano

(10) Patent No.: US 7,467,429 B2
(45) Date of Patent: Dec. 23, 2008

(54) BEDDING ARTICLE WITH CUPPED BAFFLES IN A PLURALITY OF SIDE-BY-SIDE CHANNELS

(75) Inventor: Tamara P. Soreano, Shoreline, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 11/673,402

(22) Filed: Feb. 9, 2007

(65) Prior Publication Data

US 2008/0201846 A1 Aug. 28, 2008

(51) Int. Cl.
*A47G 9/02* (2006.01)

(52) U.S. Cl. ..... 5/502; 428/166; 428/178; 112/420; 5/690

(58) Field of Classification Search ..... 5/502, 5/500, 482, 420, 690, 636, 645, 711, 712, 5/682–684; 112/420, 440; 428/166, 178
See application file for complete search history.

(56) References Cited

U.S. PATENT DOCUMENTS 1,893,548 A 1/1933 Hardy
4,115,610 A 9/1978 Wortman
4,292,702 A * 10/1981 Phillips ..... 5/683
4,426,945 A 1/1984 A-Yan
4,707,873 A 11/1987 A-Yan
5,199,121 A 4/1993 Payne
5,299,333 A 4/1994 Pedersen et al.
5,987,669 A 11/1999 Leggett et al.
6,643,872 B1 * 11/2003 Buswell ..... 5/486
7,045,191 B2 5/2006 Huntley
2003/0115670 A1 * 6/2003 Antinoro ..... 5/420

* cited by examiner

*Primary Examiner*—Alexander Grosz
(74) *Attorney, Agent, or Firm*—Clark A. Puntigam; Jensen & Puntigam P.S.

(57) ABSTRACT

The bedding article includes upper and lower fabric layers which are substantially identical in configuration and are secured to each other around the peripheries thereof. A plurality of channels are defined by channel baffle members which extend in a longitudinal direction of the bedding article. A plurality of curved, cup-like baffle elements are positioned in the channels, attached to the upper and lower fabric sections. The baffle members alternate in orientation, i.e. their direction of opening, along the length of the channel, wherein adjacent baffles which curve toward each other are spaced apart so as to permit fill to be blown into the channels and the volumes bounded by the baffle elements.

11 Claims, 3 Drawing Sheets

BEDDING ARTICLE WITH CUPPED BAFFLES IN A PLURALITY OF SIDE-BY-SIDE CHANNELS

TECHNICAL FIELD

This invention relates generally to a bedding article such as a comforter or featherbed having a plurality of side-by-side interior channels and more particularly concerns such a bedding article which combines such channels with a particular baffle arrangement within the channels.

BACKGROUND OF THE INVENTION

There are several important considerations in the design of lofted bedding articles, such as comforters and featherbeds. One important consideration is to minimize the migration, i.e. shifting, of the loose fill within the article, such as feathers and down, during use. Shifting of the fill can degrade the performance of the bedding article, as well as its appearance. Another important consideration is to create and maintain a high loft of the article. A lofty appearance of a comforter or featherbed is generally attractive to the user. Hence, it is desirable to have a comforter which is designed to minimize shifting of fill and which also has a high loft.

SUMMARY OF THE INVENTION

Accordingly, the bedding article comprises: upper and lower fabric layers, substantially identical in configuration and secured to each other around the peripheries thereof; a plurality of channels extending longitudinally of the bedding article; a plurality of cup-like baffle elements positioned along the length of the channels, the baffle elements alternating in orientation, opening toward one adjacent baffle element and away from the other adjacent baffle element, wherein the adjacent baffle elements which curve toward each other are spaced apart so as to permit fill to be blown in between them; and fill positioned within the channels including volumes bounded by the baffle elements.

BEST MODE FOR CARRYING OUT THE INVENTION

Figure 1:
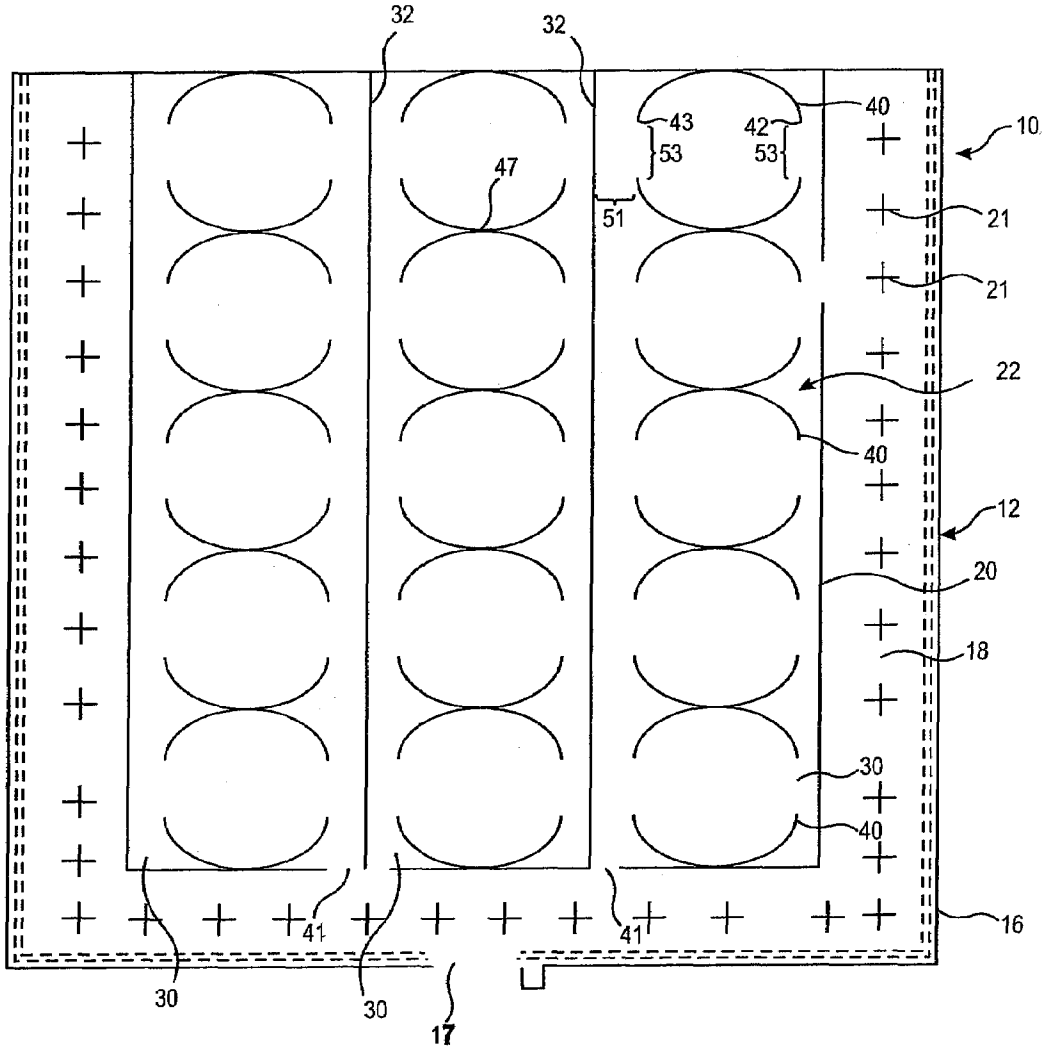
FIG. 1 is a top/internal view showing the construction of one embodiment of the bedding article.
Figure 2:
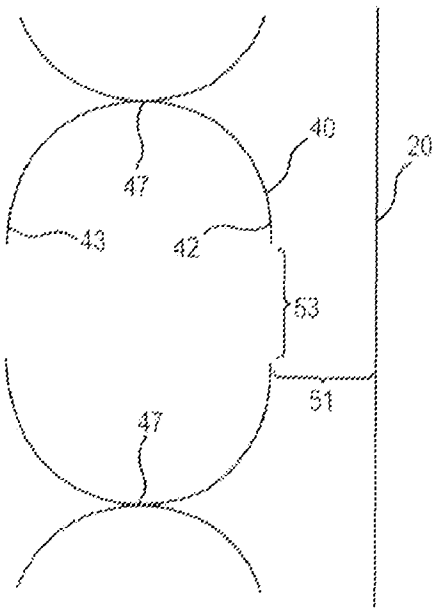
FIG. 2 is a top/internal view of a portion of the embodiment of FIG. 1.

FIGS. 1 and 2 show the first embodiment of the new bedding article, in particular, comforter referred to generally at 10. Comforter 10 includes identical upper and lower fabric sections. One such upper or lower fabric section is shown at 12 and FIG. 1. The upper or lower fabric sections are stitched around the entire periphery 16 thereof, leaving an opening 17 for blowing in loose filling during manufacture of the comforter.

The comforter 10 can be of various sizes. Typical sizes include conventional twin, full, queen and king sizes, although other sizes are possible as well. In one example, the queen size comforter will be 88 inches wide×90 inches long.

Comforter 10 includes a border region 18 in the embodiment shown which is defined by a line of stitching 20 which extends down both longitudinal sides of the comforter and across the foot of the comforter. This border region 16, however, is not necessary to the embodiment described. It adds protection against shifting of fill into portions of the comforter which may extend beyond the edges of the mattress on which the comforter is used. Located within border region 16 are a plurality of evenly spaced cross-tacks 21 which are sewn through the upper and lower fabric sections 12. The tacks are positioned on 10 inch centers and, in the embodiment shown, the lines of stitching comprising the cross-tacks are both 1½ inches long. In the embodiment shown, the border region 18 is approximately 10 inches wide, although this can vary.

Within center volume 22, defined by the line of stitching 20, a number of longitudinal channels 30-30 are defined. Each longitudinal channel extends for approximately the full length of the interior volume, and in the embodiment shown are each approximately 17 inches wide, although again this dimension can be varied. A twin size will typically have three channels, while a full and queen size will have four, and a king size will have five channels, although this also can be varied. In FIG. 1, the three channels 30-30 are shown defined by longitudinal channel baffle members 32-32. Channel baffle members 32 are approximately 0.8 inches high and are secured to the upper and lower fabric members along their lengths. Again, the height of the baffle members could vary. Within each channel 30 are a plurality of curved baffle elements 40-40, also secured to the upper and lower fabric layers along their lengths.

The arrangement and configuration of the curved baffle elements 40 is similar from channel to channel, and hence the baffle elements 40 in only one channel will be described. Baffle elements 40 in the embodiment shown are curved, approximately hemispherical from free end 42 to the opposing free end 43. The baffle elements 40 alternate in orientation so that one curves in one direction and the adjacent ones curve in the opposite direction. They all open, however, in the direction of the channel, either forward or to the rear thereof.

Apart from those baffle elements at the opposing ends of the channel, baffle elements 40 are positioned in back-to-back pairs with one baffle element in the pair opening toward one end of the channel and the other baffle element 40 opening toward the other end of the channel. This arrangement is clearly illustrated in FIG. 1. Each pair of elements touch or come close together at approximately their midpoints 47, as shown in FIGS. 1 and 2. They can touch or be secured together at that point, but typically are not secured, since such an arrangement would make filling more difficult. The present arrangement allows for maximum loft.

The space 51 between the free ends 42 and 43 of each baffle element 40 and the adjacent channel baffle members 32, which form the channel in which the baffle elements are located, is approximately 3 inches, while the openings 53 between the free ends of adjacent baffle elements which extend toward each other is within the range of 5¾-6¼ inches, with a preferred opening of approximately 6 inches. This opening permits fill to be blown into the areas partially defined or bounded by the baffle elements.

The baffle elements can take other specific configurations, including V-shaped and/or other angular arrangements. However, the general configuration of each element is cup-like or bucket-like, with the baffle elements always being positioned such that they alternate in the direction they face (i.e. open) along the channel. The baffle elements will typically be positioned along the full length of each channel, but fewer baffle elements could be used in one or more of the channels, so they do not necessarily extend the full length of the channel. The function of the baffle elements 40 is to capture and trap the fill, much like curved or cupped hands. The arrangement results in a "cradling" of the fill between each back-to-back baffle pair, minimizing shifting of the fill and creating a lofty appearance for the product.

In the manufacture of the comforter, there is an opening 41 provided at the foot end of each channel in the comforter, which allows fill to be blown in to fill each channel, as well as opening 18, which allows fill to be blown into the border region. Typically the fill will be loose, such as feathers, down and/or a combination thereof, although polyester pieces may also be used. After the comforter has been filled, openings 41 to the channels and opening 18 to the comforter itself are closed, such as by sewing.

Figure 3:
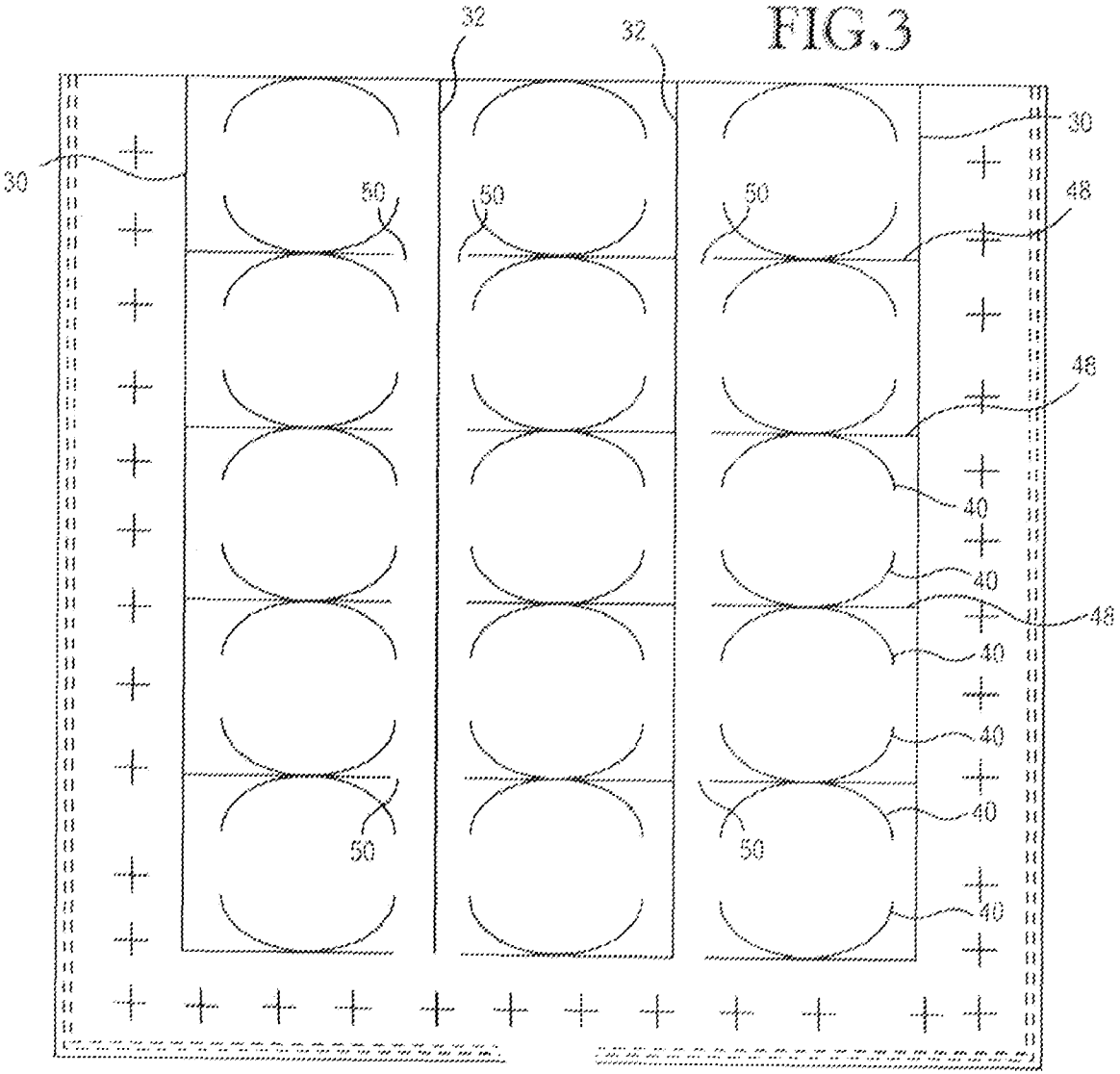
FIG. 3 is a top/internal view of a variation of the embodiment of FIG. 1.

FIG. 3 shows a variation of the comforter of FIGS. 1 and 2. In FIG. 3, a horizontal baffle 48 is present between each back-to-back pair of curved baffle elements. Horizontal baffles 48 are secured, by sewing, to the upper and lower fabric layers. Typically, the horizontal baffle will extend from one channel baffle member 32 or border 30 to a point close to the adjacent baffle member 32 forming the channel, leaving an opening 50 so that filling can pass along the entire channel. The horizontal baffles 48 are the same height as the curved baffle elements 40 and the channel baffle members 32, and provide additional protection against shifting of the fill during use.

The comforter of FIGS. 1, 2 and 3 with the cup-like baffle element arrangement holds and maintains the fill within the comforter, bending to minimize shifting of the fill during use, while at the same time providing a pleasant, high-loft appearance to the comforter.

Figure 4:
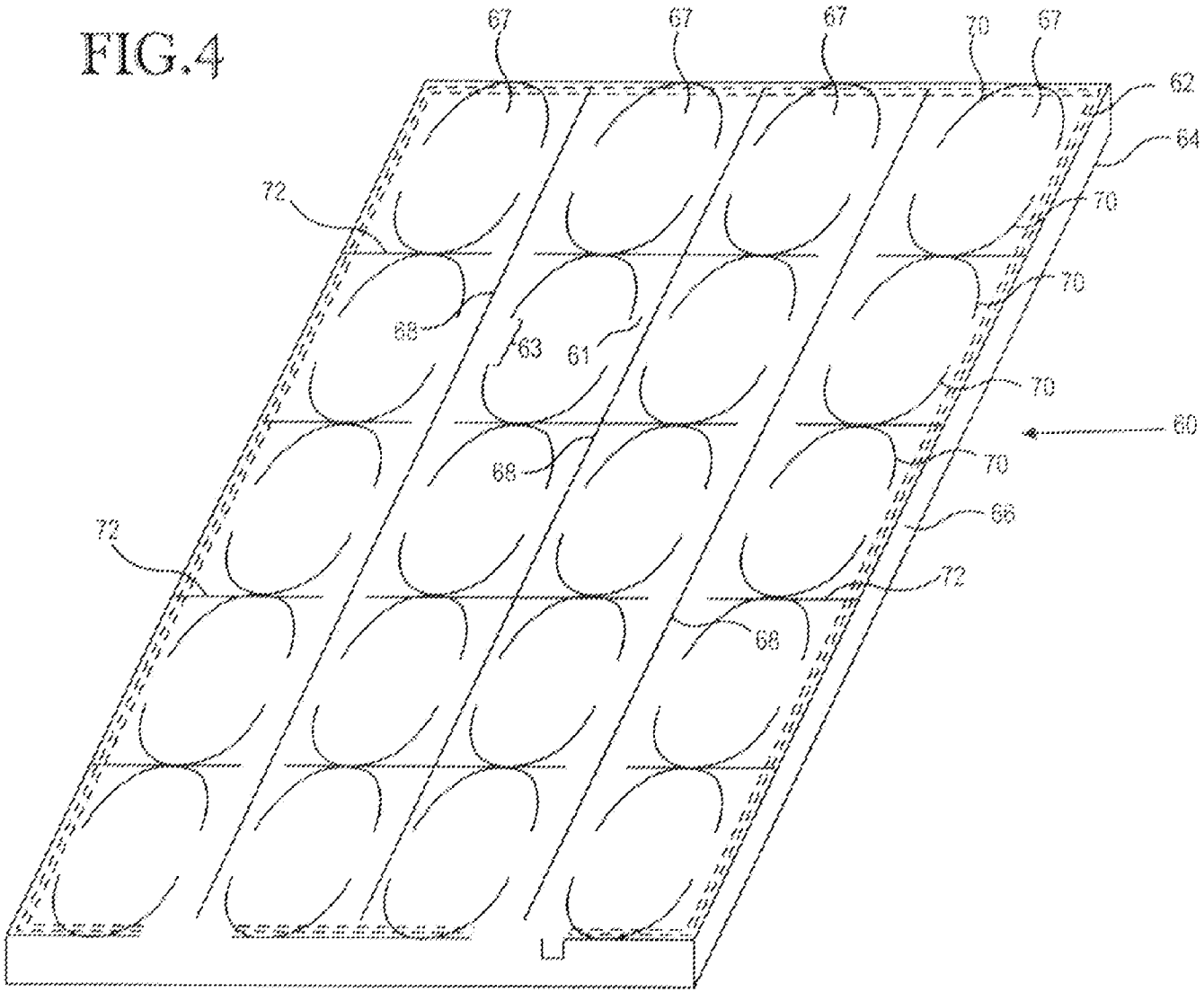
FIG. 4 is a top/internal view of another embodiment of the bedding article.

FIG. 4 shows another embodiment of the new bedding article, in particular, a featherbed, shown generally at 60. Featherbed 60 comprises upper and lower identical fabric layers 62 and 64, separated by a gusset 66 which extends completely around the periphery of the featherbed. Featherbed 60 may be different sizes, including conventional twin, full, queen and king size, as well as other sizes. The gusset can vary in height but in the embodiment shown is approximately 4 inches high.

Like the comforter, featherbed 60 will be divided into a plurality of longitudinal channels 67-67, with the channels preferably being approximately equal in width, although the width of the channels in a particular embodiment can vary from channel to channel. The channels are defined by baffle members 68-68 and gusset 66. Positioned within each channel are a plurality of curved baffle elements 70-70, similar to that shown and described for the embodiment in FIGS. 1-3. In each channel 67 there are single baffle elements at the ends thereof, the baffle elements opening in opposing directions along the channel.

Positioned between the curved baffle elements at the ends of each channel are a plurality of back-to-back baffle element combinations, the back-to-back element combinations touching each other approximately at the midpoints thereof, but opening in opposing directions, aligned with the direction of the channel. The distance 61 between the curved baffle elements 70 and the channel baffle members 68 defining the channels is approximately 3 inches, the same as for the embodiment of FIGS. 1-3, while the distance 63 between the free ends of adjacent baffle elements which open toward each other is approximately 6 inches, again like that of the embodiment of FIGS. 1-3.

The featherbed of FIG. 4 also includes a plurality of horizontal baffles 72-72 in each channel. The horizontal baffles are positioned between the back-to-back baffle element pairs, such that the two baffle elements in each pair touch the horizontal baffle element. The horizontal baffle elements extend from one channel baffle member or the gusset to a point close to the adjacent channel baffle member.

The number of channels and the number of curved baffle elements in each channel will vary depending on the size of the featherbed. For instance a queen size featherbed will have 4 side-by-side channels, with a total of 10 baffle elements (5 baffle pairs)+4 horizontal baffles in each channel. The horizontal baffles in the channel structure of FIG. 4 define a baffle box arrangement. There are two baffle elements in each baffle box, opening toward each other, as shown. This arrangement provides the same functionality with respect to minimizing shifting and migration of filling while maintaining a high loft for the featherbed embodiment as for the comforter arrangement.

Although FIG. 4 includes horizontal baffles, it is not necessary that the featherbed have horizontal baffles.

Hence, a bedding article, particularly a comforter and/or a featherbed, has been described which includes a particular channel and baffle arrangement which minimizes shifting of the fill and maintains a high loft of the bedding article.

Although a preferred embodiment of the invention has been disclosed here for the purposes of illustration, it should be understood that various changes, modifications and substitutions may be incorporated in the embodiment without departing from the spirit of the invention, which is defined by the claims which follow.

What is claimed is:

1. A bedding article, comprising:

upper and lower fabric layers, substantially identical in configuration and secured to each other around the peripheries thereof;

a plurality of channels extending longitudinally of the bedding article;

a plurality of cup-like baffle elements positioned along the length of the channels, the baffle elements alternating in orientation, opening toward one adjacent baffle element and away from the other adjacent baffle element, wherein the adjacent baffle elements which curve toward each other are spaced apart so as to permit fill to be blown in between them; and generally solid fill positioned within the channels including volumes bounded by the baffle elements.

2. The bedding article of claim 1, wherein the baffle elements are approximately hemispherical.

3. The bedding article of claim 1, wherein adjacent baffle elements which curve away from each other form pairs of baffle elements which touch each other at approximately midpoints thereof.

4. The bedding article of claim 1, wherein the adjacent baffle elements which curve toward each other are separated by a distance within the range of five and three-quarters to six and a quarter inches at the free ends thereof.

5. The bedding article of claim 1, wherein the channels are defined by channel walls and wherein the baffle elements are separated from the channel walls by approximately three inches.

6. The bedding article of claim 3, including horizontal baffles which extend for a substantial portion of the width of each channel, positioned between adjacent baffle elements which curve away from each other, such that the baffle elements contact the horizontal baffle at approximately a midpoint of the baffle elements.

7. The bedding article of claim 1, wherein the baffle elements extend for substantially the entire length of each channel.

8. The bedding article of claim 1, wherein the bedding article is a comforter which includes a border region extending around both sides and foot of the comforter.

9. The bedding article of claim 8, including a plurality of cross tacking lines of sewing securing the upper and lower fabric layers together at spaced intervals along the border region.

10. The bedding article of claim 1, wherein the bedding article is a featherbed.

11. The bedding article of claim 1, wherein the baffle elements are approximately four inches high.

* * * * *